United States Patent [19]

Mathews

[11] 4,099,771

[45] Jul. 11, 1978

[54] SEAT ADAPTED TO BE MOUNTED ON VEHICLE TIRE

[76] Inventor: Robert P. Mathews, 5014 Ampere St., Pittsburgh, Pa. 15207

[21] Appl. No.: 805,186

[22] Filed: Jun. 9, 1977

[51] Int. Cl.[2] ..... A47C 1/00

[52] U.S. Cl. ..... 297/217; 248/158

[58] Field of Search ..... 297/217, 130; 248/158, 248/415, 127; 108/150, 161

[56] References Cited

U.S. PATENT DOCUMENTS

| | | | |
|---|---|---|---|
| 1,224,405 | 5/1917 | Nienstadt | 248/158 X |
| 1,752,105 | 3/1930 | Nash | 108/150 |
| 3,010,774 | 11/1961 | Doherty | 297/217 |
| 4,010,914 | 3/1977 | Kowalski | 248/158 X |

FOREIGN PATENT DOCUMENTS

| | | | |
|---|---|---|---|
| 1,953,650 | 6/1970 | Fed. Rep. of Germany | 248/158 |
| 923,991 | 2/1955 | Fed. Rep. of Germany | 108/161 |
| 474,987 | 8/1969 | Switzerland | 108/150 |

*Primary Examiner*—Francis K. Zugel

*Attorney, Agent, or Firm*—Buell, Blenko & Ziesenheim

[57] ABSTRACT

A seat adapted for mounting on a vehicle tire has a seat with a sleeve extending vertically from the bottom of the seat. A rod is adapted to engage the sleeve. A base plate is attached perpendicularly to the rod and a suitable means is used to attach the base plate to the vehicle tire.

4 Claims, 3 Drawing Figures

10
40
12
14
34
36
18
16
26
38
20
31
22
26
32
24
30
28

10
12
34
30

SEAT ADAPTED TO BE MOUNTED ON VEHICLE TIRE

This invention relates to seats adapted to be mounted on vehicle tires and which utilize the tire for support.

Vehicle seats have been disclosed which contain a cavity for storage of a spare tire such as is described in British Pat. No. 1,044,892. However, such seats provide merely storage areas for tires and do not utilize the tire for supporting the seat. One of the objects of this invention is to provide a seat which utilizes the vehicle tire to support it.

Another object of this invention is to utilize the space directly over the vehicle tire when the tire is stored in a vehicle. Spare tires are often carried in the cargo areas of van type vehicles. Such vehicles oftentimes have only two seats in front of the cargo area and hence can comfortably accommodate only two people. When a spare tire is carried in a van the space above the tire often is not used because the irregular shape of the tire is likely to cause cargo placed on the tire to shift when the vehicle is in motion. I have developed a seat which can be mounted on the spare tire to provide a chair for an additional passenger in a van and which utilizes the space directly above the tire.

Since the seat utilizes only the spare tire, it can be as portable as the tire and may be used outside of the vehicle. The seat may be especially useful during camping, hunting and fishing trips.

I prefer to provide a seat or chair having a sleeve extending vertically from the base of the chair, a rod adapted to engage the sleeve to permit the chair to swivel and a base plate to which the rod is attached and adapted to fit the wheel portion of modern vehicle tires. I further prefer to provide holes in the base plate to permit the base plate to be bolted to the wheel through the mounting holes of the wheel. I also prefer to provide a locking means to prevent the chair from swivelling when such movement is not desired.

To prevent the seat from shifting in the vehicle while the vehicle is in motion, I prefer to provide a mounting plate onto which the vehicle tire and seat are mounted.

Other details, objects and advantages of the invention will become apparent as the following description of a present preferred embodiment proceeds.

In the accompanying drawings, I have shown a present preferred embodiment of the invention in which.

Figure 2:
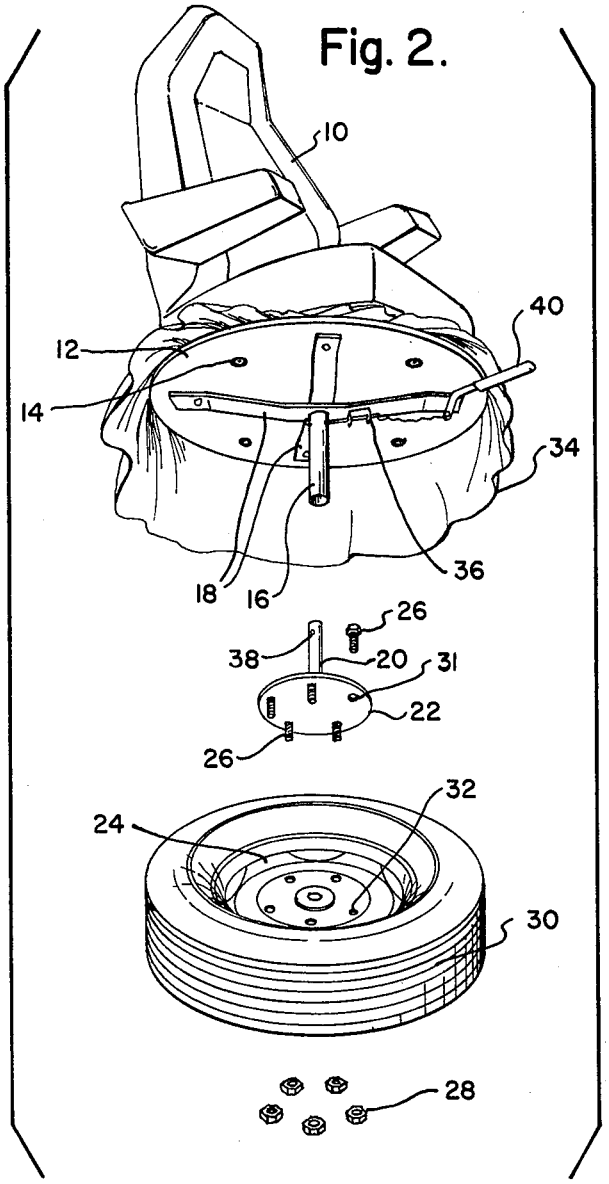
FIG. 2 is an exploded isometric view of the embodiment of FIG. 1.
Figure 1:
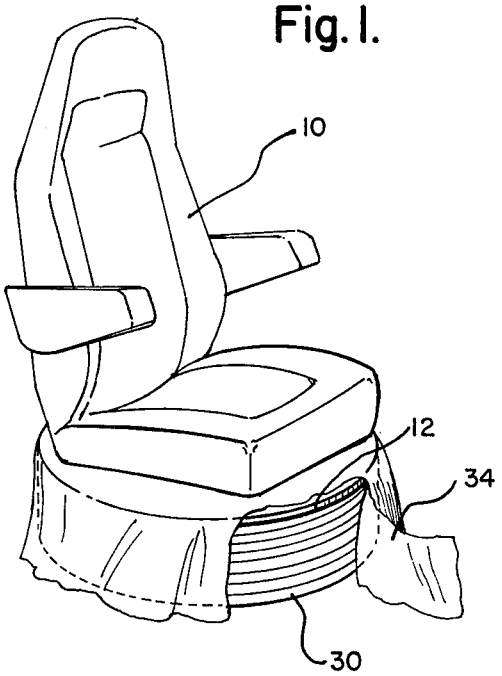
FIG. 1 is an isometric view of a present preferred embodiment of the apparatus.
Figure 3:
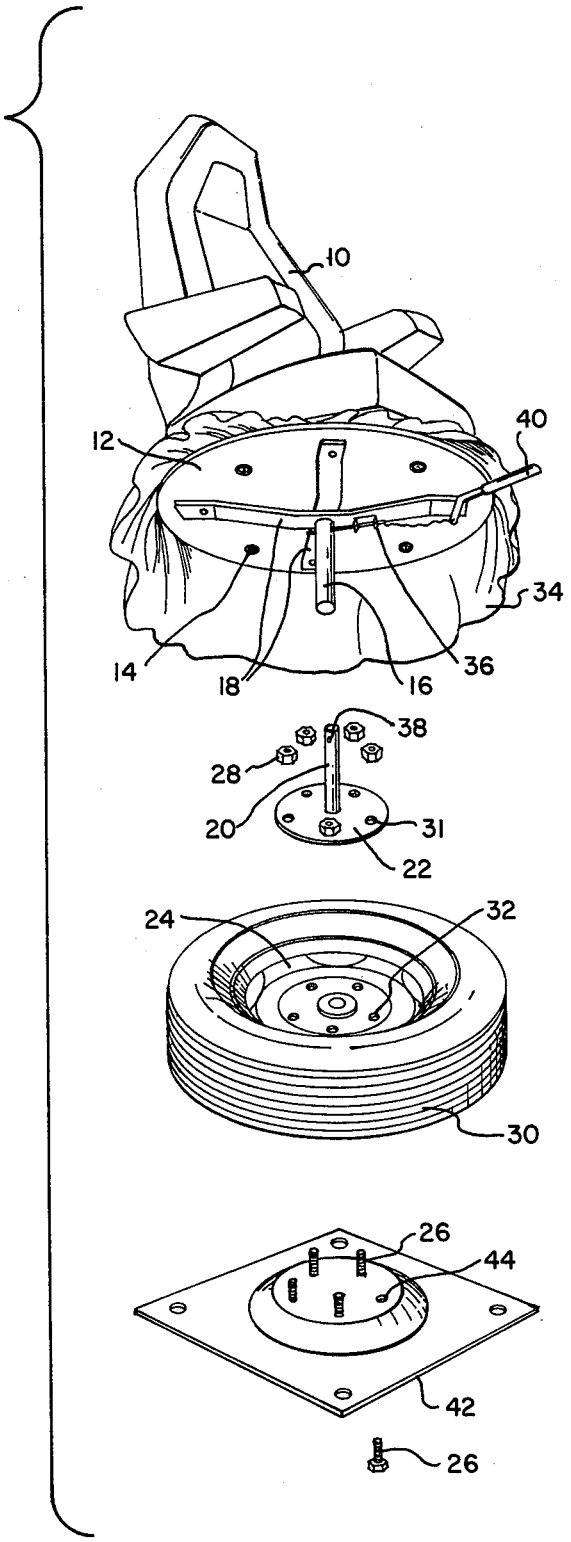
FIG. 3 is an exploded isometric view of another embodiment utilizing a mounting plate for the vehicle tire and seat.

Referring to the drawings, a chair 10 is attached to a base 12 by screws 14. The base 12 is sized to fit over vehicle tire 30. A hollow cylindrical sleeve 16 is attached to the base 12 and held in place by braces 18. The sleeve 16 fits over a rod 20 which is attached to a plate 22 having a plurality of holes 31. The plate 22 is sized to fit over the center portion or wheel 24 of the vehicle tire 30 and held in place by bolts 26 which pass through holes 32 in the wheel 24 and the holes 31 in the plate 22 and are fitted with nuts 28. A mounting plate 42 (see FIG. 3) can be attached to the floor of the vehicle (not shown) onto which the vehicle tire 30 and plate 22 are mounted by bolts 26 which pass through mounting plate holes 44, wheel holes 32 and plate holes 31 and are fitted with nuts 28. When attached to the mounting plate 42 the seat will not move while the vehicle is in motion. A skirt 34 is attached to base 12 to cover the vehicle tire 30. To prevent the chair 10 from rotating a spring loaded pin 36 is provided to pass through the sleeve 16 and engage hole 38 provided in the rod 20. This pin 36 can be released by moving the handle 40 which will allow the chair 10 to be rotated.

In the foregoing specification, I have set out a present preferred embodiment of my invention, however, it will be understood that this invention may otherwise be embodied within the scope of the following claims.

I claim:

1. A chair adapted to be mounted on a spare vehicle tire comprising:

(a) a vehicle pneumatic tire mounted on a wheel member with a hub area and a rim which together form a well, the hub area having plurality of stud bolt holes;

(b) a seat member;

(c) a seat base plate mounted on the bottom of the seat member and spaced above the tire member just enough to allow rotational movement of the seat base plate with respect to the tire;

(d) a sleeve and rod assembly in which the rod is engaged within the sleeve and both members slide freely with respect to each other, the length of the assembly being approximately the depth of the well, one end of the assembly is attached to the seat base plate, the other end of the assembly having a flange with a plurality of holes which are aligned with the stud bolt holes in the hub; and (e) a nut and bolt assembly corresponding to each of the holes in the hub and flange securing the flange to hub.

2. A chair as recited in claim 1 including a mounting plate having a raised portion to engage the well, the raised portion having a plurality of holes aligned with the hub and flange holes and the bolts passing through the holes, the mounting plate having a flange plate portion which can be secured to a floor of a vehicle.

3. A chair as recited in claim 1 including a releasable locking pin means engaging the sleeve and rod assembly to prevent rotation of the sleeve with respect to the rod when the pin is engaged.

4. A chair as recited in claim 2 including a releasable locking pin means engaging the sleeve and rod assembly to prevent rotation of the sleeve with respect to the rod when the pin is engaged.

* * * * *